US008339319B2

(12) United States Patent
Chen

(10) Patent No.: US 8,339,319 B2
(45) Date of Patent: Dec. 25, 2012

(54) BROADBAND ANTENNA

(75) Inventor: Lung-Pao Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 320 days.

(21) Appl. No.: 12/894,117

(22) Filed: Sep. 29, 2010

(65) Prior Publication Data

US 2011/0234457 A1 Sep. 29, 2011

(30) Foreign Application Priority Data

Mar. 25, 2010 (CN) ..... 2010 2 0141776 U

(51) Int. Cl.
*H01Q 1/38* (2006.01)
*H01Q 1/24* (2006.01)

(52) U.S. Cl. ..... 343/700 MS; 343/829; 343/846

(58) Field of Classification Search ..... None
See application file for complete search history.

(56) References Cited

U.S. PATENT DOCUMENTS 4,396,920 A 8/1983 Grimberg et al.
7,705,784 B2 * 4/2010 Lai et al. ..... 343/700 MS
7,884,771 B2 * 2/2011 Tseng et al. ..... 343/702
7,986,275 B2 * 7/2011 Huang et al. ..... 343/700 MS
8,035,563 B2 * 10/2011 Ishimiya ..... 343/700 MS
8,274,436 B2 * 9/2012 Huang ..... 343/702
2011/0043408 A1 * 2/2011 Shi et al. ..... 343/700 MS
2011/0273343 A1 * 11/2011 Qi et al. ..... 343/702

* cited by examiner

*Primary Examiner* — Trinh Dinh
(74) *Attorney, Agent, or Firm* — Altis Law Group, Inc.

(57) ABSTRACT

A broadband antenna printed on a substrate. The substrate includes a first surface, a second surface perpendicular to the first surface, and a third surface parallel to the first surface. The broadband antenna includes a grounding portion, a feeding portion, and a radiating portion. The grounding portion is located on the first surface. The feeding portion feeds electromagnetic signals and includes a first feeding section printed on the third surface and a second feeding section printed on the second surface. The radiating portion includes a first radiating section, a second radiating section, and a third radiating section. The first radiating section is printed on the first surface. The second radiating section comprises a first radiating segment and a second radiating segment. The third radiating section is printed on the second surface and formed a ladder portion.

10 Claims, 4 Drawing Sheets

BROADBAND ANTENNA

RELATED APPLICATIONS

This application claims priority under 35 U.S.C. 119 from CHINA Application Number 201020141776.2 filed on Mar. 25, 2010, the contents of which are incorporated herein by references.

BACKGROUND

1. Technical Field

Embodiments of the present disclosure relate to antennas, and more particularly to a broadband antenna.

2. Description of Related Art

Antennas are required to cover different frequency bands. Currently, most of the antennas each employ multiple groups of resonators working in neighboring bands to broaden their covered band. However, those resonators in the antenna often lead unstable transmission efficiency in the covered band of the antenna. Therefore, a broadband antenna which has stable transmission efficiency is needed.

BRIEF DESCRIPTION OF THE DRAWINGS

The details of the disclosure, both as to its structure and operation, can best be understood by referring to the accompanying drawings, in which like reference numbers and designations refer to like elements.

DETAILED DESCRIPTION

The details of the disclosure, both as to its structure and operation, can best be understood by referring to the accompanying drawings, in which like reference numbers and designations refer to like elements.

Figure 1:
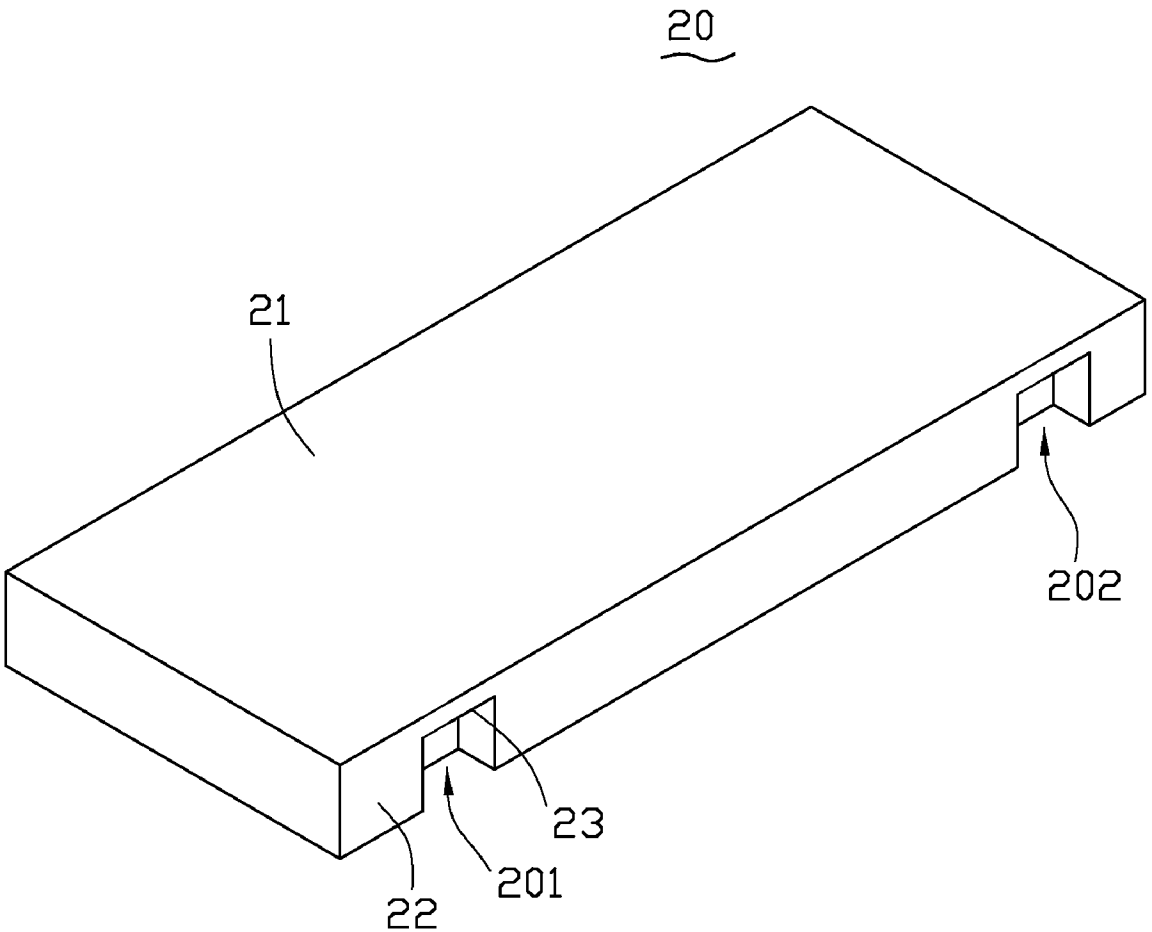
FIG. 1 is a schematic diagram of one embodiment of a substrate.

FIG. 1 is a schematic diagram of one embodiment of a substrate 20. As shown, the substrate 20 comprises a first surface 21, a second surface 22, and a third surface 23. In one embodiment, the second surface 22 is perpendicular to the first surface 21, and the third surface 23 is parallel to the first surface 21. In one embodiment, the substrate 20 defines a first recess 201 and a second recess 202.

Figure 2:
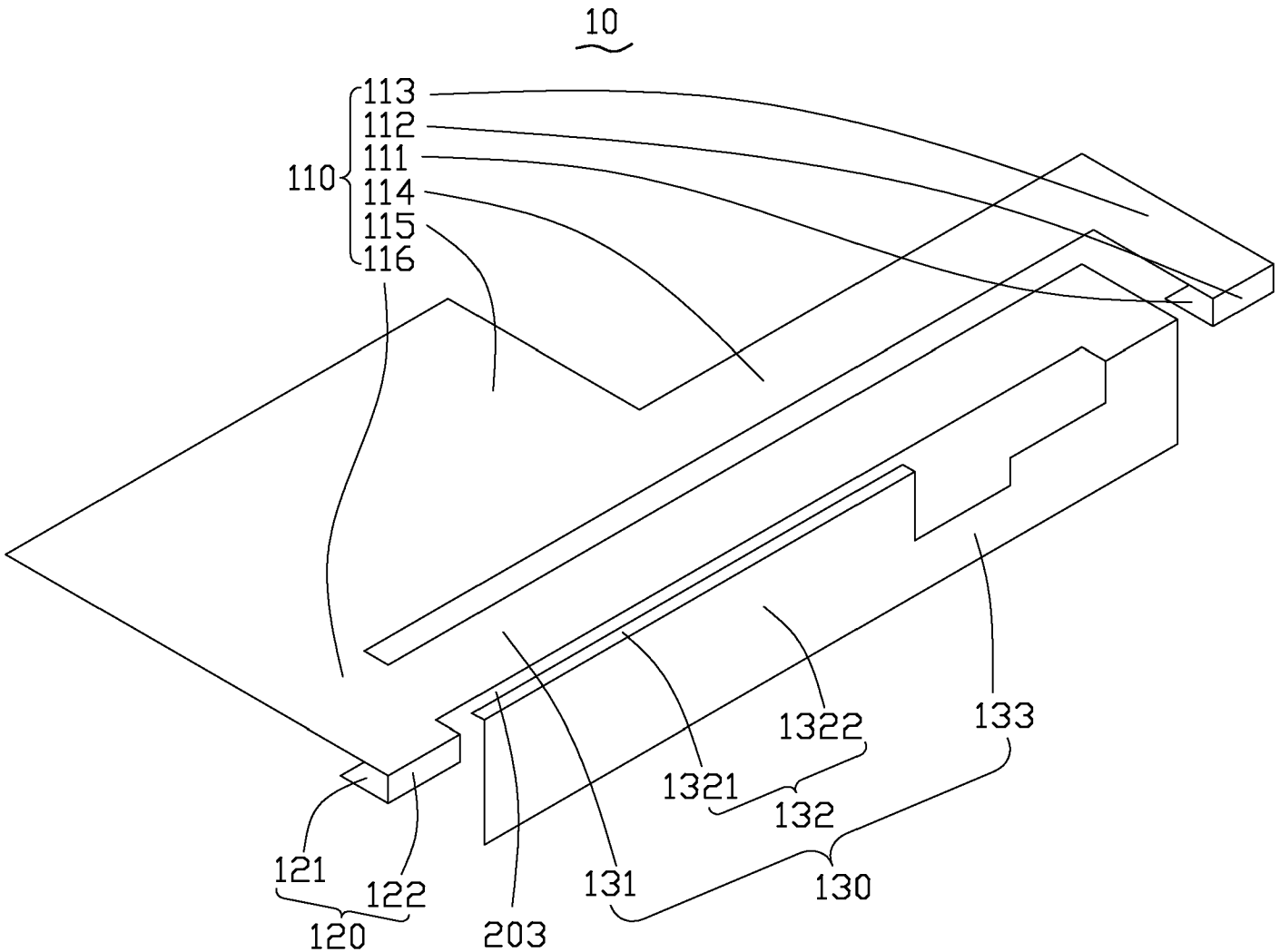
FIG. 2 is a schematic diagram of one embodiment of a broadband antenna.

FIG. 2 is a schematic diagram of one embodiment of a broadband antenna 10. As shown, the broadband antenna 10 comprises a grounding portion 110, a feeding portion 120, and a radiating portion 130. The radiating portion 130 connects to the grounding portion 110 and the feeding portion 120. In one embodiment, the broadband antenna 10 can be used on a mobile station of global system for mobile communication (GSM) network, such as a GSM mobile phone.

Figure 3:
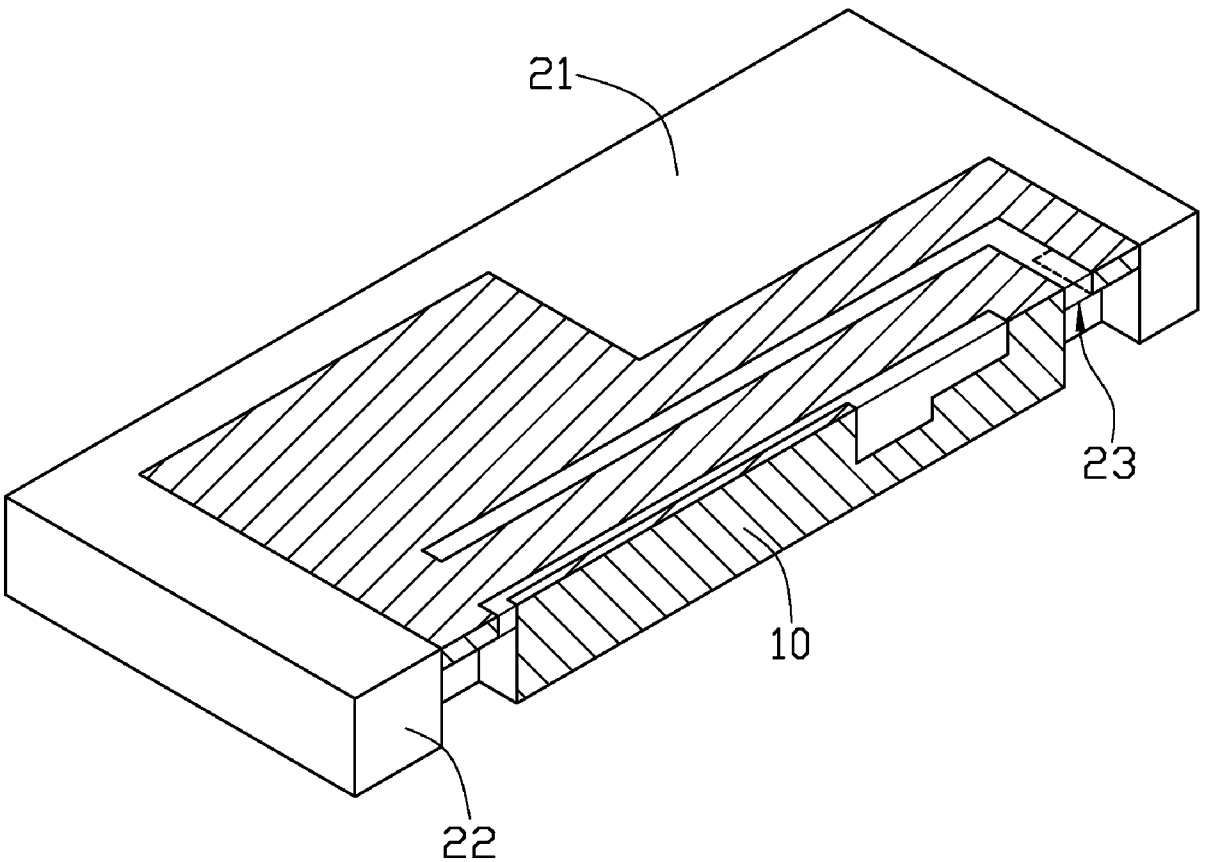
FIG. 3 is a schematic diagram of one embodiment of the broadband antenna of FIG. 2 printed on the substrate of FIG. 1.

FIG. 3 is a schematic diagram of one embodiment of the broadband antenna 10 of FIG. 2 printed on the substrate 20 of FIG. 1. As shown, the broadband antenna 10 is printed on the first surface 21, the second surface 22, and the third surface 23 of substrate 20.

The grounding portion 110 comprises a first grounding section 111, a second grounding section 112, a third grounding section 113, a fourth grounding section 114, a fifth grounding section 115, and a sixth grounding section 116. In one embodiment, the first grounding section 111 is a rectangular stripe and printed on the third surface 23 of the substrate 20. The second grounding section 112 is a rectangular stripe and printed on the second surface 22 of the substrate 20. The third grounding section 113, the fourth grounding section 114, the fifth grounding section 115, and the sixth grounding section 116 are printed on the first surface 21 of the substrate 20.

In one embodiment, the first grounding section 111, the second grounding section 112, the third grounding section 113, the fourth grounding section 114, the fifth grounding section 115 and the sixth grounding section 116 are connected one by one. In detail, the first grounding section 111 is perpendicularly connected to the second grounding section 112. The third grounding section 113 is perpendicularly connected to the second grounding section 112. The fourth grounding section 114 is perpendicularly connected to the third grounding section 113. The third grounding section 113 and the fourth grounding section 114 collectively form an L-shape. The fifth grounding section 115 is a rectangle and connected to the fourth grounding section 114. The sixth grounding section 116 is perpendicularly connected to the fifth grounding section 115, and parallel to the third grounding section 113.

The feeding portion 120 feeds electromagnetic signals and comprises a first feeding section 121 and a second feeding section 122. In one embodiment, the first feeding section 121 connects to a resource signal to feed electromagnetic signals and is printed on the third surface 23 of the substrate 20. The second feeding section 122 is printed on the second surface 22 of the substrate 20. The first feeding section 121 is perpendicularly connected to the second feeding section 122.

The radiating portion 130 radiates electromagnetic signals and comprises a first radiating section 131, a second radiating section 132, and a third radiating section 133. In one embodiment, the first radiating section 131 is printed on the first surface 21 of the substrate 20 and electrically connected to the second feeding section 122, and shaped in "π". The first radiating section 131 is connected between the sixth grounding section 116 and the second feeding section 122.

The second radiating section 132 comprises a first radiating segment 1321 and a second radiating segment 1322.

In one embodiment, the first radiating segment 1321 is perpendicularly connected to the second radiating segment 1322. The first radiating segment 1321 and the second radiating segment 1322 are printed on the first surface 21 and the second surface 22, respectively. In one embodiment, the first radiating segment 1321 of the second radiating section 132 and the first radiating section 131 collectively define a stripe gap 203 which is parallel to the first radiating section 131.

The third radiating section 133 is printed on the second surface 22 of the substrate 20, and forms a ladder portion. The third radiating section 133 is connected to the first radiating section 131 and the second radiating section 132. In one embodiment, the third radiating section 133 converts an impedance of the electromagnetic signals feed by the feeding portion 120 by way of the ladder portion to broaden band of the broadband antenna 10.

In one embodiment, one sidewall of each of the first recesses 201 and the second recesses 202 is on the third surface 23. In one embodiment, the first feeding section 121 is printed on the one sidewall of the first recess 201, and the first grounding section 111 is printed on the one sidewall of the second recess 202.

The broadband antenna 10 of the present disclosure broadens covered band of the broadband antenna 10 by way of the ladder portion of the third radiation section 133. In addition, the he broadband antenna 10 overcomes the unstable transmission efficiency in the covered band, which is verified in FIG. 4.

Generally, working band of GSM network is 850/900 MHz. That is, transmitting band of the broadband antenna 10 in the GSM network is 824-890 MHz and receiving band of the broadband antenna 10 in the GSM network is 880-960 MHz. In a traditional way, a fluctuation of the return loss of most broadband antennas may be 10 dB in the covered band of 824-960 MHz which shows unstable transmission efficiency.

Figure 4:
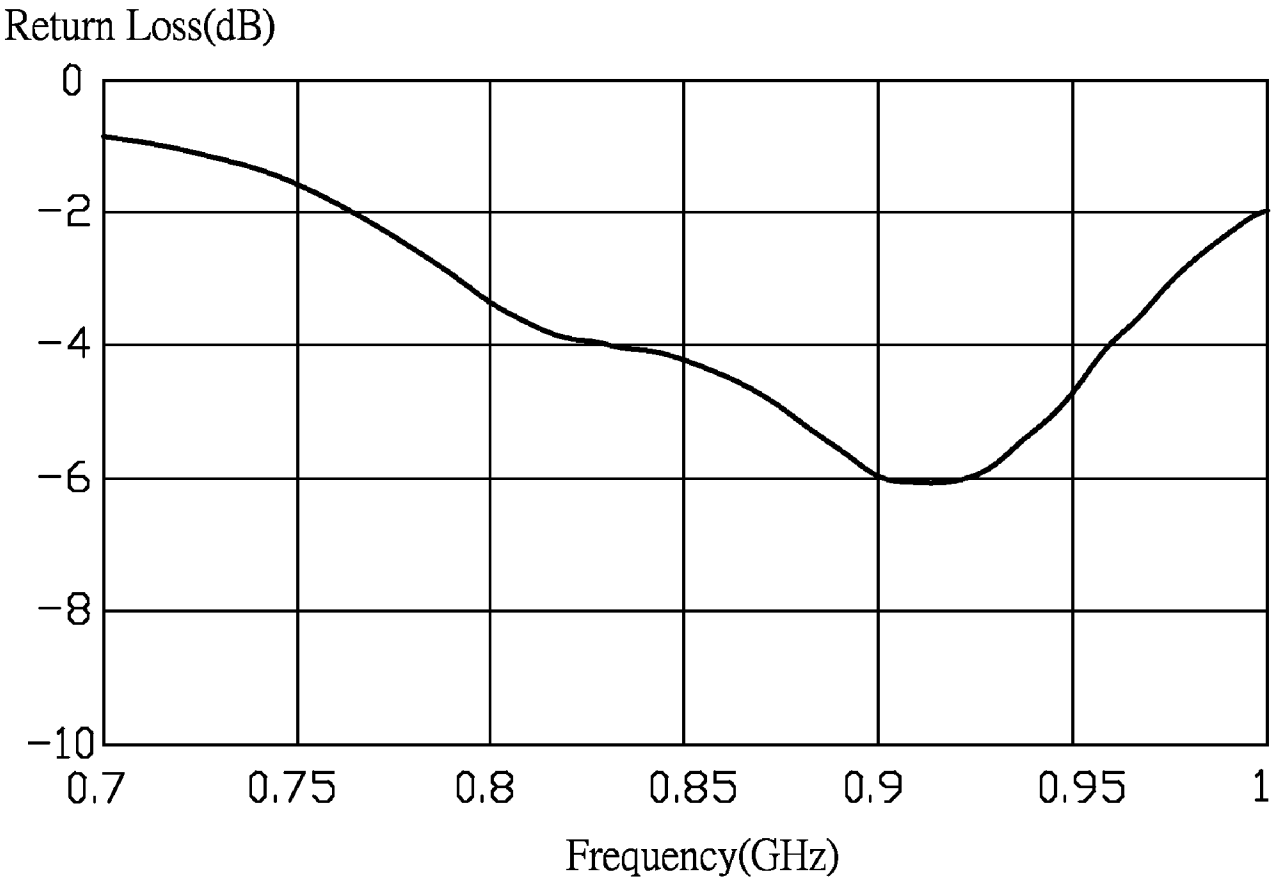
FIG. 4 is a schematic diagram showing an exemplary return loss of the broadband antenna of FIG. 2.

FIG. 4 is a schematic diagram showing an exemplary return loss of the broadband antenna 10 of FIG. 2. As shown, the return loss of the broadband antenna 10 between 824 MHz~960 MHz changes substantially from −4 dB to −6 dB, so the fluctuation of the return loss between 824 MHz~960 MHz is about 2 dB which is much less than normal level. Therefore, the transmission efficiency of the broadband antenna 10 of the present disclosure is much more stable in the covered band of 824-960 MHz.

While various embodiments and methods of the present disclosure have been described, it should be understood that they have been presented by example only and not by limitation. Thus the breadth and scope of the present disclosure should not be limited by the above-described embodiments, but should be defined only in accordance with the following claims and their equivalents.

What is claimed is:

1. A broadband antenna printed on a substrate, the substrate comprising a first surface, a second surface perpendicular to the first surface, and a third surface parallel to the first surface, the broadband antenna comprising:

a grounding portion located on the first surface;

a feeding portion to feed electromagnetic signals, the feeding portion comprising a first feeding section and a second feeding section, wherein the first feeding section is printed on the third surface, and the second feeding section is printed on the second surface; and a radiating portion connected to the grounding portion and the feeding portion, the radiating portion comprising:

a first radiating section printed on the first surface and electrically connected to the second feeding section;

a second radiating section comprising a first radiating segment and a second radiating segment, wherein the first radiating segment is printed on the first surface, and the second radiating segment is printed on the second surface; and a third radiating section printed on the second surface and comprising a ladder portion to connect the first radiating section and the second radiating section.

2. The broadband antenna as claimed in claim 1, wherein the grounding portion comprises a first grounding section printed on the third surface, a second grounding section printed on the second surface, a third grounding section printed on the first surface, and a fourth grounding section printed on the first surface, wherein the first, second, third and fourth grounding sections are connected one by one.

3. The broadband antenna as claimed in claim 2, wherein the first grounding section is perpendicularly connected to the second grounding section, the second grounding section is perpendicularly connected to the third grounding section, and the fourth grounding section is perpendicularly connected to the third grounding section.

4. The broadband antenna as claimed in claim 2, wherein the grounding portion further comprises a fifth grounding section printed on the first surface, and a sixth grounding section printed on the first surface.

5. The broadband antenna as claimed in claim 4, wherein the fifth grounding section is perpendicularly connected to the sixth grounding section.

6. The broadband antenna as claimed in claim 5, wherein the first radiating section is connected between the sixth grounding section and the second feeding section.

7. The broadband antenna as claimed in claim 4, wherein a stripe gap is defined between the first radiating segment of the second radiating section and the first radiating section, and the stripe gap is parallel to the first radiating section.

8. The broadband antenna as claimed in claim 2, wherein the substrate defines a first recess and a second recess.

9. The broadband antenna as claimed in claim 8, wherein one sidewall of each of the first and second recesses is on the third surface.

10. The broadband antenna as claimed in claim 8, wherein the first feeding section is printed on the sidewall of the first recess, and the first grounding section is printed on the sidewall of the second recess.

* * * * *